US007216502B2

(12) United States Patent
Jeong et al.

(10) Patent No.: US 7,216,502 B2
(45) Date of Patent: May 15, 2007

(54) REFRIGERATOR

(75) Inventors: Bu-kil Jeong, Kwangsan-gu (KR); Sung-chul Kang, Kwangsan-gu (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 329 days.

(21) Appl. No.: 10/821,167

(22) Filed: Apr. 9, 2004

(65) Prior Publication Data

US 2005/0160755 A1 Jul. 28, 2005

(30) Foreign Application Priority Data

Jan. 28, 2004 (KR) ..... 10-2004-0005426

(51) Int. Cl.
*F25D 3/02* (2006.01)

(52) U.S. Cl. ..... 62/318

(58) Field of Classification Search ..... 62/318
See application file for complete search history.

(56) References Cited

U.S. PATENT DOCUMENTS

| | | | |
|---|---|---|---|
| 3,982,406 | A | 9/1976 | Hanson et al. |
| 5,135,645 | A | 8/1992 | Sklenak et al. |
| 5,907,958 | A | 6/1999 | Coates et al. |
| 6,355,177 | B2 | 3/2002 | Senner et al. |

FOREIGN PATENT DOCUMENTS

| | | | |
|---|---|---|---|
| EP | 0 881 928 | B1 | 3/2003 |
| KR | 93-9313 | U | 5/1993 |
| KR | 96-32208 | U | 10/1996 |
| KR | 0130584 | YI | 1/1999 |
| KR | 1999-00074720 | | 10/1999 |
| KR | 1999-0020583 | U | 12/2000 |
| KR | 2000-0020573 | U | 12/2000 |
| KR | 2001-00060724 | | 7/2001 |
| KR | 10-0333617 | B1 | 4/2002 |
| KR | 10-0361671 | B1 | 11/2002 |
| KR | 20-0293506 | Y1 | 2/2003 |
| KR | 2003-0092871 | A | 12/2003 |

*Primary Examiner*—Chen Wen Jiang
*Assistant Examiner*—B. Clayton McCraw
(74) *Attorney, Agent, or Firm*—Sughrue Mion, PLLC

(57) ABSTRACT

A refrigerator includes a main body having at least one refrigerating compartment; a door to open and close an opening of the refrigerating compartment; a water dispenser provided on the door to supply drinking water; a drawer provided inside the refrigerating compartment; and a filter assembly disposed behind the drawer to filtrate water supplied to the water dispenser. Thus, the refrigerator has more available space and the filter assembly can be exchanged by the user with ease. Further, the refrigerator has a better appearance inside the cooling compartment and the cost for the filter assembly is reduced.

2 Claims, 5 Drawing Sheets

REFRIGERATOR

CROSS-REFERENCE TO RELATED APPLICATIONS

This application claims the benefit of Korean Patent Application No. 2004-005426 filed on Jan. 28, 2004, in the Korean Intellectual Property Office, the disclosure of which is incorporated herein by reference.

BACKGROUND OF THE INVENTION

1. Field of the Invention

The present invention relates to a refrigerator and, more particularly, to a refrigerator in which a filter assembly can be exchanged with ease and an available space in the refrigerator is increased.

2. Description of the Related Art

As shown in FIG. 5, a conventional refrigerator is divided into a freezing compartment 110 and a cooling compartment 120 by a partition in a right-and-left direction. On each of the openings of the freezing compartment 110 and the cooling compartment 120 are provided a freezing compartment door 111 and a cooling compartment door 121 each having respective door guides 112 and 122 to accommodate bottles and the like in an up-and-down direction inside of the freezing compartment door 111 and the cooling compartment door 121.

The freezing compartment 110 formed in the left side of a main body has an ice making compartment 115 to make ice at an upper part thereof and is provided with a plurality of freezing compartment shelves 113 and freezing compartment drawers 114 in an up-and-down direction under the ice making compartment 115. On a front surface of the freezing compartment door 111 is a dispensing part to which ice made in the ice making compartment 115 and drinking water from the outside are supplied. The dispensing part comprises a water dispenser to supply drinking water and an ice dispenser to supply ice.

The cooling compartment 120 formed in the right side of the main body is provided with a plurality of cooling compartment shelves 123 to divide the inside of the cooling compartment 120 at an upper part of the cooling compartment 120 in an up-and-down direction and a plurality of cooling compartment drawers 124 at a lower part thereof. On the cooling compartment shelf 123 positioned at the most upper part is provided a filter assembly 140 to filtrate water supplied from a separate water supply part and supply the filtrated water to a water tank (not shown) connected to the water dispenser.

However, in the conventional refrigerator, because the filter assembly is mounted on the cooling compartment shelf positioned at the most upper part, a user must remove foods that have been placed on the cooling compartment shelves of the cooling compartment in order to exchange the spent filter cartridge with a new filter cartridge, which provides an inconvenience to exchange the filter cartridge.

Further, the filter assembly is mounted on the cooling compartment shelf, which harms an outer appearance and reduces the available space in the refrigerator. Further, a distance between the filter assembly at the upper part of the cooling compartment and the water tank at the lower part of the cooling compartment is long, which requires a long hose and increases a cost to connect the long hose.

SUMMARY OF THE INVENTION

Accordingly, it is an aspect of the present invention to provide a refrigerator in which a filter assembly is exchanged with ease and an available space is increased.

The foregoing and/or other aspects of the present invention are achieved by providing a refrigerator comprising: a main body having at least one refrigerating compartment; a door to open and close an opening of the refrigerating compartment; a water dispenser provided on the door to supply drinking water; a drawer provided inside the refrigerating compartment; and a filter assembly disposed behind the drawer to filtrate water supplied to the water dispenser.

According to an aspect of the invention, the filter assembly is mounted on a rear surface of the refrigerating compartment to be provided between a rear surface of the drawer and the rear surface of the refrigerating compartment when the drawer is accommodated in the refrigerating compartment.

According to an aspect of the invention, the refrigerator further comprises a water tank provided behind the drawer together with the filter assembly to contain the water filtrated by the filter assembly.

According to an aspect of the invention, the rear surface of the drawer comprises a transparent area that is made of transparent material and through which the filter assembly can be seen and a non-transparent area that is made of non-transparent material and through which the water tank cannot be seen.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
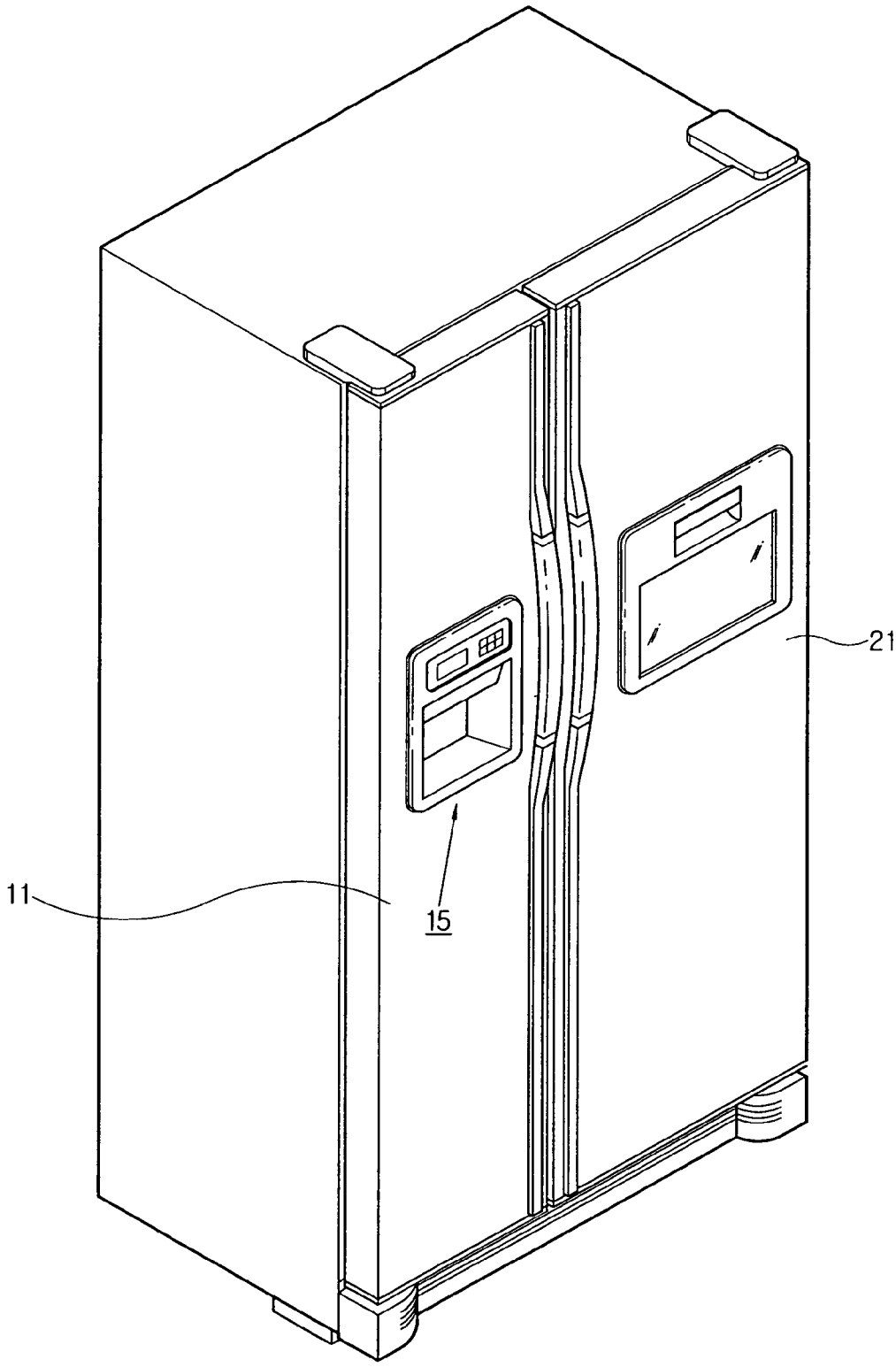
FIG. 1 is a perspective view of a refrigerator according to an embodiment of the present invention.

Reference will now be made in detail to the preferred embodiments of the present invention, examples of which are illustrated in the accompanying drawings, wherein like reference numerals refer to the like elements throughout. The embodiments are described below in order to explain the present invention by referring to the figures.

Figure 2:
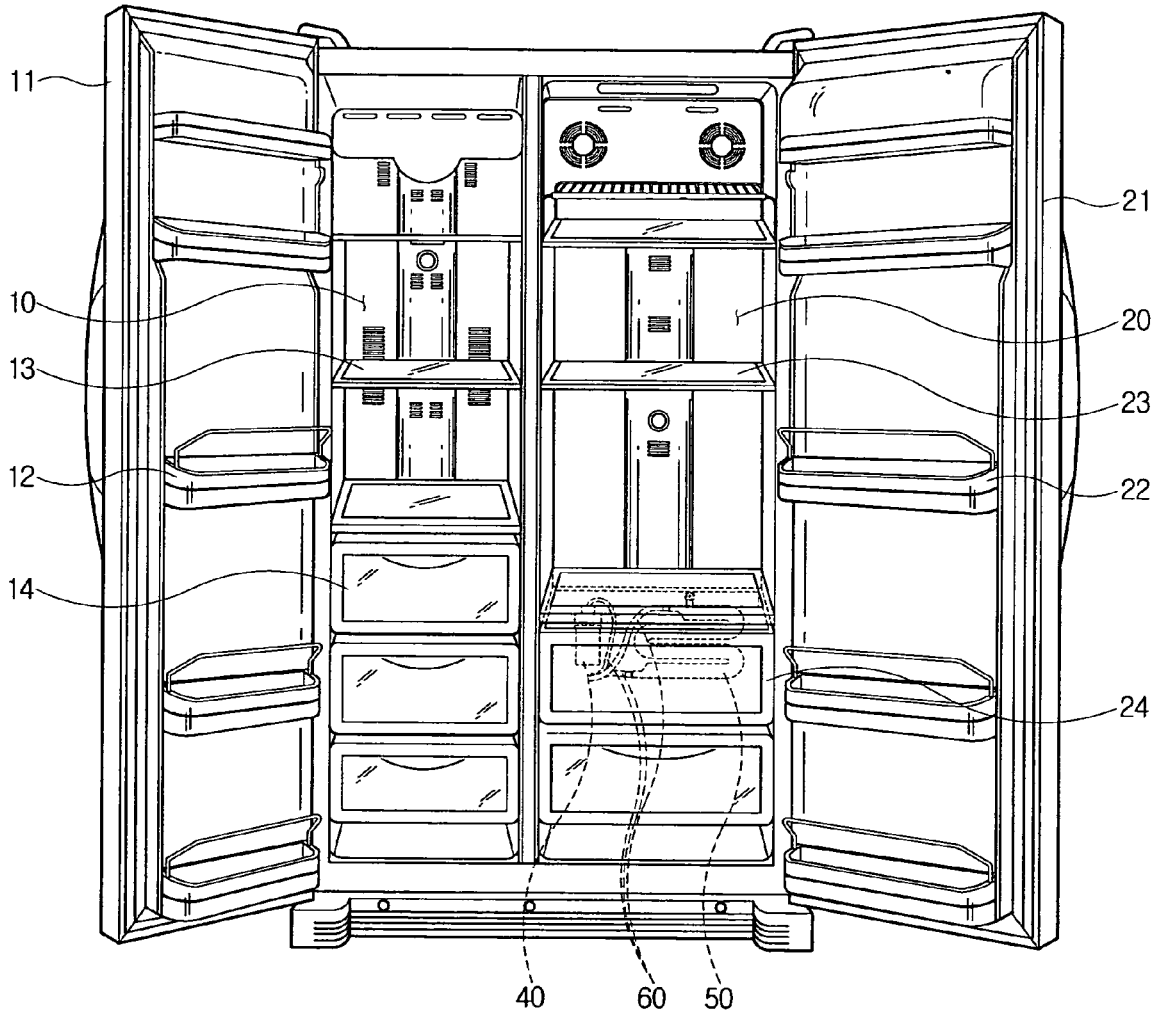
FIG. 2 shows that doors of the refrigerator of FIG. 1 are opened.
Figure 3:
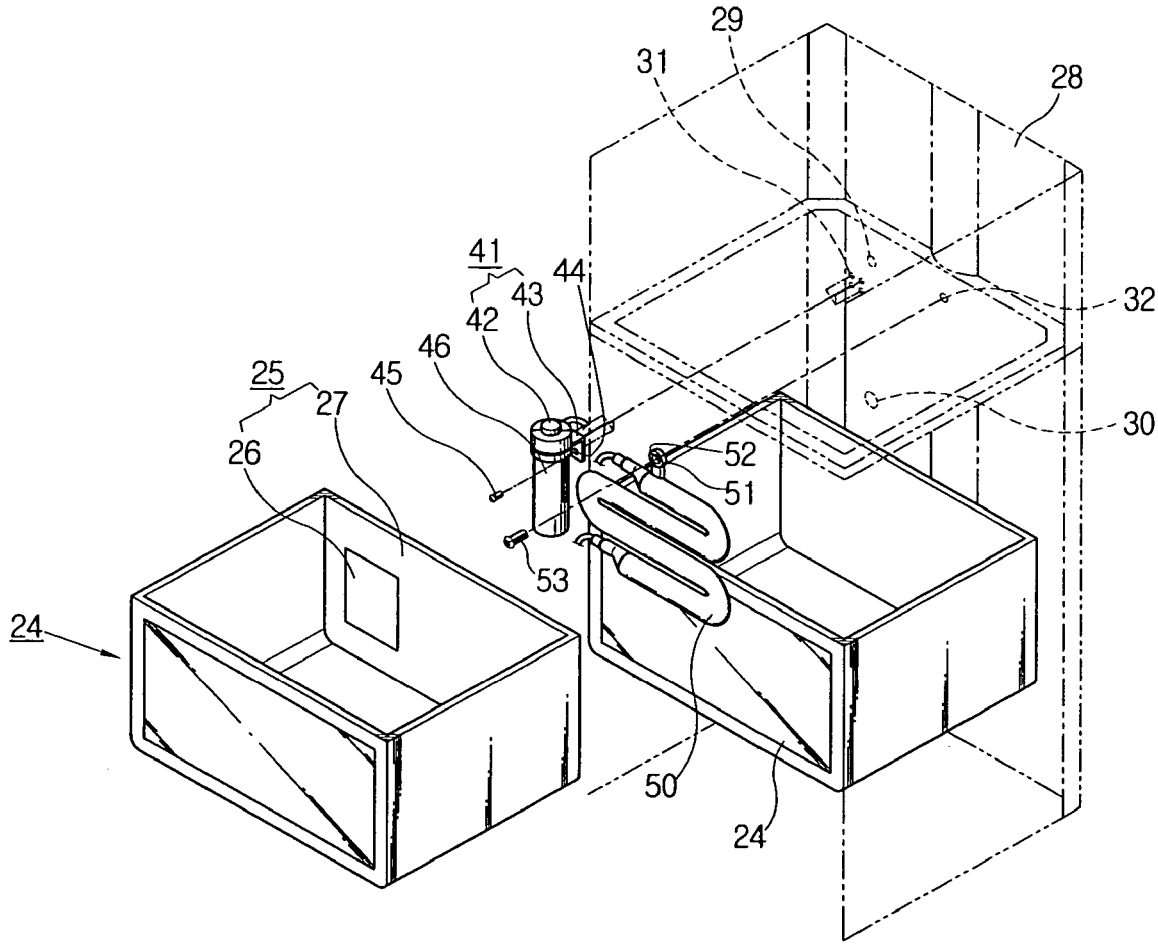
FIG. 3 is an exploded view showing an area in which a filter assembly of the refrigerator of FIG. 2 is mounted.
Figure 4:
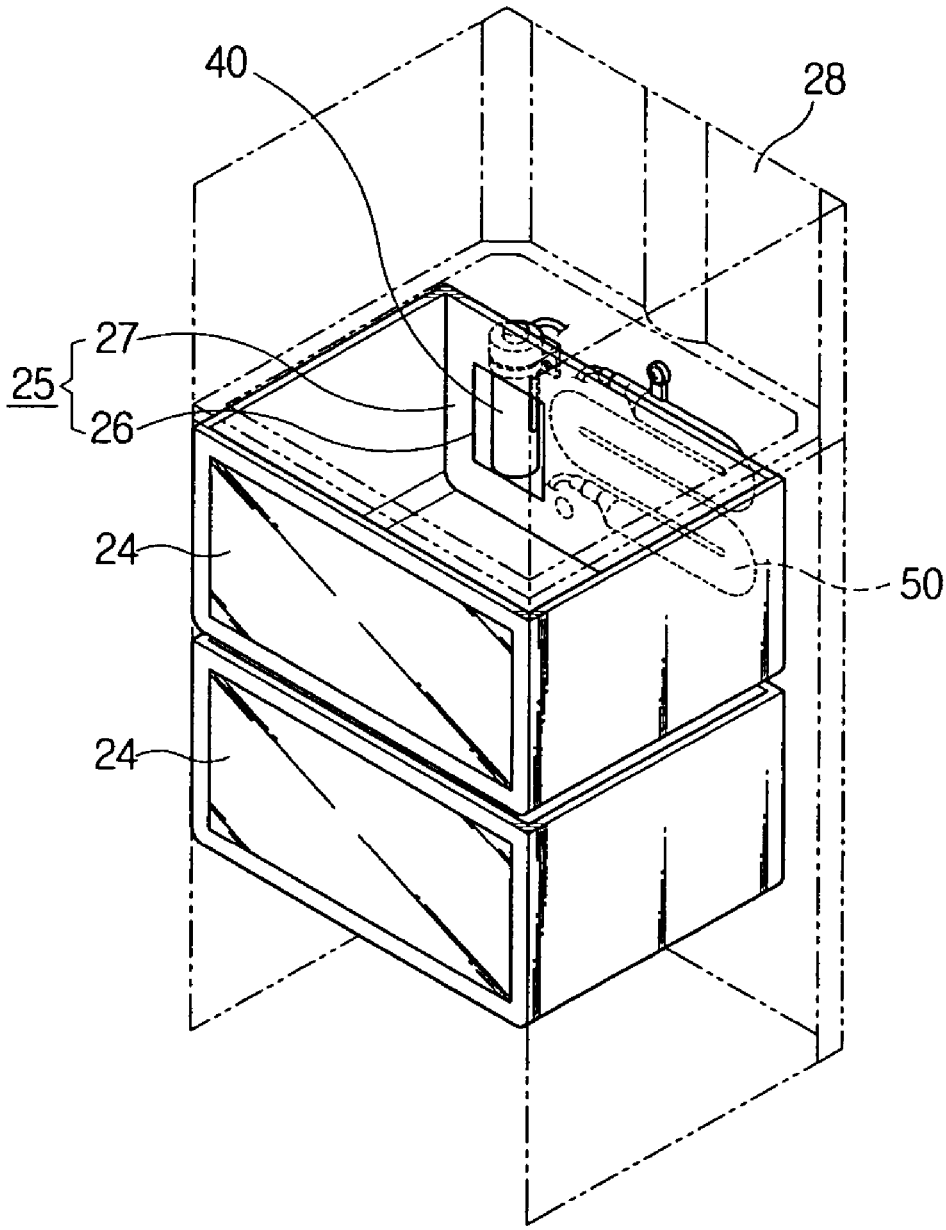
FIG. 4 is a perspective view showing an area in which the filter assembly of the refrigerator of FIG. 2 is mounted.
Figure 5:
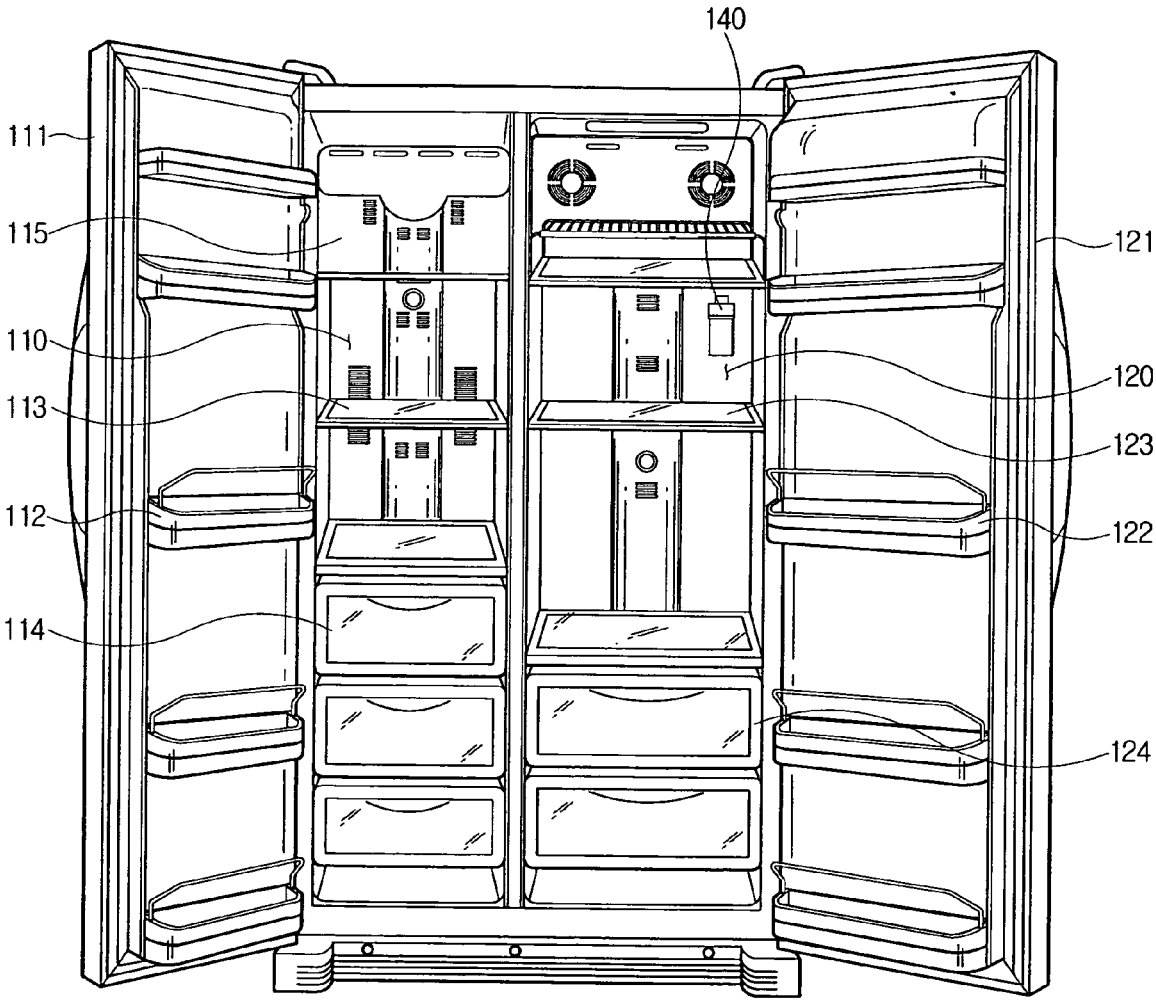
FIG. 5 (PRIOR ART)
FIG. 5 shows that doors of a conventional refrigerator are opened.

As shown in FIGS. 1 through 4, a partition divides a refrigerator according to an embodiment of the present invention into a freezing compartment 10 and a cooling compartment 20 in a right-and-left direction. Each of the freezing compartment 10 and the cooling compartment 20 has a freezing compartment door 11 and a cooling compartment door 21 to open/close each of a front opening of the freezing compartment 10 and the cooling compartment 20. Inside the freezing compartment door 11 and the cooling compartment door 21 are provided door guides 12 and 22 to accommodate bottles and the like in an up-and-down direction. On a rear surface 28 of the cooling compartment 20 are formed first and second hose through holes 29 and 30 for a filter assembly 40 and a water tank 50 (to be described later).

The freezing compartment 10 formed in the left side of a main body is provided with a plurality of freezing compartment shelves 13 and freezing compartment drawers 14 in an up-and-down direction. On a front surface of the freezing compartment door 11 is provided a dispensing part 15 to which ice made in the ice making compartment and drinking water from the outside are supplied. The dispensing part 15 comprises a water dispenser to supply drinking water and an ice dispenser to supply ice.

The cooling compartment 20 formed in the right side of the main body is provided with a plurality of cooling compartment shelves 23 to divide the inside of the cooling compartment 20 in an up-and-down direction at an upper part of the cooling compartment 20 and a plurality of cooling compartment drawers 24 at a lower part thereof, behind which the filter assembly 40 and the water tank 50 are provided.

The filter assembly 40 is securely mounted on the rear surface 28 of the cooling compartment 20 to be positioned between a rear surface 25 of one of the cooling compartment drawers 24 and the rear surface 28 of the cooling compartment 20. That is, in the state that the cooling compartment drawers 24 are accommodated in the cooling compartment 20, the filter assembly 40 is securely mounted on the rear surface 28 of the cooling compartment 20 facing the rear surface 25 of the cooling compartment drawer 24, so that a front of the filter assembly 40 faces the rear surface 25 of the cooling compartment drawer 24 and a rear of the filter assembly 40 faces the rear surface 28 of the cooling compartment 20.

The filter assembly 40 filtrates water supplied from a water supplying part (not shown) to supply it to the water tank 50. The filter assembly 40 comprises a head 41 securely mounted on the rear surface 28 of the cooling compartment 20 and a filter cartridge 46 detachably connected to the head 41.

The filter cartridge 46 is connected to the water supply part with a hose 60 to filtrate impurities included in the water supplied from the water supply part and detachably connected to the head 41 to be exchanged by a user after a use of a predetermined period of time.

The head 41 comprises a head main body 42 of a cylinder shape, a fixing part 43 extending from the head main body 42 in a radial direction and bent downwardly. The fixing part 43 is formed with a bolt through hole 44 in which a bolt 45 inserted in a bolt-inserting hole 31 formed on the rear surface 28 of the cooling compartment 20 is inserted.

The water filtrated by the filter assembly 40 is contained in the water tank 50, which is supplied to the water dispenser.

The water tank 50 is securely mounted on the rear surface 28 of the cooling compartment 20 together with the filter assembly 40 to be positioned between the rear surface 25 of the cooling compartment drawer 24 and the rear surface 28 of the cooling compartment 20. That is, in the state that the cooling compartment drawers 24 are accommodated in the cooling compartment 20, the water tank 50 is securely mounted on the rear surface 28 of the cooling compartment 20 facing the rear surface 25 of the cooling compartment drawer 24, so that a front of the water tank 50 faces the rear surface 25 of the cooling compartment 20 and a rear of the water tank 50 faces the rear surface 28 of the cooling compartment drawer 24. Here, a screw 53 passes through a screw through-hole 52 of a connecting part 51 provided at a side of the water tank 50 and is inserted in a screw hole 32 formed on the rear surface 28 of the cooling compartment 20, so that the water tank 50 is securely mounted on the rear surface 28 of the cooling compartment 20.

The rear surface 25 of the cooling compartment drawer 24 positioned in the front of the filter assembly 40 and the water tank 50 comprises a transparent area 26 that is made of transparent material and positioned corresponding to the filter assembly 40 and through which the filter assembly 40 can be seen and a non-transparent area 27 that is made of non-transparent material and positioned with the exception of the transparent area and through which the water tank 50 cannot be seen.

With a configuration described above, a description of a method to securely mount the filter assembly 40 and the water tank 50 on the rear surface 28 of the cooling compartment 20 and to exchange the filter assembly 40 to a new filter follows.

First, the filter assembly 40 is positioned on the rear surface 28 of the cooling compartment 20 facing the rear surface 25 of the cooling compartment drawer 24 and the bolt 45 is inserted in the bolt through-hole 44 formed in the fixing part 43 of the filter assembly 40 to be inserted in the bolt-inserting hole 31 formed on the rear surface 28 of the cooling compartment 20, so that the filter assembly 40 is securely mounted on the rear surface 28 of the cooling compartment 20. Then, the water tank 50 is positioned in the vicinity of the filter assembly 40 and the screw 53 is inserted in the screw through-hole 52 formed on the connecting part 51 of the water tank 50 to be inserted in the screw hole 32 formed on the rear surface 28 of the cooling compartment 20, so that the water tank 50 is securely mounted on the rear surface 28 of the cooling compartment 20. The cooling compartment drawer 24 is slid into the cooling compartment 20, so that the rear surface 25 of the cooling compartment drawer 24 approaches the filter assembly 40 and the water tank 50. Then, the filter assembly 40 and the water tank 50 are provided behind cooling compartment drawer 24. Thus, water supplied from the water supply part to the filter assembly 40 is filtrated by the filter cartridge 46 of the filter assembly 40 and supplied to the water tank 50, so that water contained in the water tank 50 is supplied to the water dispenser. Then, a user can drink cool water supplied from the water dispenser.

Moreover, if the filter cartridge 46 of the filter assembly 40 needs to be exchanged after a use of a predetermined period of time, the user draws the whole cooling compartment drawer 24 out of the cooling compartment 20 with ease. Then, the water tank 50 and the filter assembly 40 mounted on the rear surface 28 of the cooling compartment 20 are exposed to the outside, so that the user can detach the filter cartridge 46 from the head 41 and connect a new filter cartridge 46 to the head 41. Thereafter, if the user pushes the cooling compartment drawer 24 into the cooling compartment 20, the exchange of the filter cartridge 46 is completed.

In the conventional refrigerator, foods put on the cooling compartment shelves must be pulled out of the cooling compartment shelves to exchange the filter cartridge of the filter assembly. However, in the refrigerator according to the present invention, to exchange the filter cartridge 46 of the filter assembly 40, it is only required that the user draws the cooling compartment drawer 24 out of the cooling compartment 20 and pushes the cooling compartment drawer 24 into the cooling compartment 20, which makes the exchange of the filter cartridge 46 much easier.

Further, the filter assembly 40 and the water tank 50 are positioned behind cooling compartment drawer 24, which increases an available space in the refrigerator.

Moreover, in the present invention, different from the conventional refrigerator in which the filter assembly is exposed to the outside, the filter assembly 40 of the present invention is covered by the rear surface 25 of cooling compartment drawer 24, which provides a better appearance inside the cooling compartment 20. The filter assembly 40 and the water tank 50 are provided in the vicinity, which reduces the length of a hose to connect the filter assembly 40 and the water tank 50 and a cost to connect the hose.

As described above, the present invention provides the refrigerator that has the more available space and in which the filter assembly can be exchanged by the user with ease.

Further, the present invention provides a refrigerator that has the better appearance inside the cooling compartment and in which cost for the filter assembly is reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a main body having at least one refrigerating compartment;

a door to open and close an opening of the refrigerating compartment;

a water dispenser provided on the door to supply drinking water;

a drawer provided inside the refrigerating compartment;

a filter assembly disposed behind the drawer to filtrate water supplied to the water dispenser; and a water tank provided behind the drawer together with the filter assembly to contain the water filtrated by the filter assembly, wherein the rear surface of the drawer comprises a transparent area that is made of transparent material and through which the filter assembly can be seen and a non-transparent area that is made of non-transparent material and through which the water tank cannot be seen.

2. A refrigerator comprising:

a main body having at least one refrigerating compartment;

a door to open and close an opening of the refrigerating compartment;

a water dispenser provided on the door to supply drinking water;

a drawer provided inside the refrigerating compartment;

a filter assembly disposed behind the drawer to filtrate water supplied to the water dispenser, wherein the filter assembly is mounted on a rear surface of the refrigerating compartment to be provided between a rear surface of the drawer and the rear surface of the refrigerating compartment when the drawer is accommodated in the refrigerating compartment; and a water tank provided behind the drawer together with the filter assembly to contain the water filtrated by the filter assembly, wherein the rear surface of the drawer comprises a transparent area that is made of transparent material and through which the filter assembly can be seen and a non-transparent area that is made of non-transparent material and through which the water tank cannot be seen.

* * * * *